US007311556B2

(12) United States Patent
Wan et al.

(10) Patent No.: US 7,311,556 B2
(45) Date of Patent: Dec. 25, 2007

(54) ELECTRICAL CONNECTOR

(75) Inventors: Feng Wan, Kunshan (CN); Jin-Kui Hu, Kunshan (CN); Guo-Hua Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/526,535

(22) Filed: Sep. 25, 2006

(65) Prior Publication Data

US 2007/0149053 A1 Jun. 28, 2007

(30) Foreign Application Priority Data

Sep. 26, 2005 (CN) ..... 2005 2 0075934 U

(51) Int. Cl.
*H01R 13/648* (2006.01)

(52) U.S. Cl. ..... 439/607

(58) Field of Classification Search ..... 439/607, 439/608–610, 131, 31, 108, 358, 352
See application file for complete search history.

(56) References Cited

U.S. PATENT DOCUMENTS 5,509,819 A * 4/1996 Stein et al. ..... 439/189
5,797,770 A 8/1998 Davis
5,973,947 A * 10/1999 Shih ..... 363/144
5,980,321 A * 11/1999 Cohen et al. ..... 439/608
6,155,872 A 12/2000 Wu
6,193,554 B1 2/2001 Wu
6,238,244 B1 5/2001 Yang
6,364,672 B1 * 4/2002 Miyazoe et al. ..... 439/131
2006/0228929 A1 * 10/2006 Ko ..... 439/352
2007/0059961 A1 * 3/2007 Cartier et al. ..... 439/191

* cited by examiner

*Primary Examiner*—J. F. Duverne
(74) *Attorney, Agent, or Firm*—Wei Te Chung

(57) ABSTRACT

An electrical connector (100) adapted for electrically connecting with corresponding mating connectors (200) includes an insulative housing (1) defining a base portion (10), a couple of upper and lower tongue plates (11, 12) extending forwardly from the base portion (10), as well as a holding plate (13) between the tongue plates (11, 12). First and second sets of conductive terminals (31, 32) are accommodated in the tongue plates (11, 12) and a couple of upper and lower shielding members (21, 22) enclosing the tongue plates for surrounding the conductive terminals. The dimension of the holding plate (13) is greater than the dimension of the adjacent dielectric portions of the mating connectors (200) in a vertical direction. When two mating connectors are inserted to the housing for connecting with the electrical connector, they cannot intervene with each other so as to affect signal transmission.

14 Claims, 8 Drawing Sheets

ELECTRICAL CONNECTOR

BACKGROUND OF THE INVENTION

1. Field of the Invention

This invention generally relates to an electrical connector, and more particularly to a stacked electrical connector which is mounted on a printed circuit board.

2. Description of the Prior Art

With the rapid development of the electronic and telecommunication industries, the advantage of stacked connectors, as taking up less spaces than two independent connectors, becomes more and more obviously. U.S. Pat. No. 6,238,244 B1, discloses such a stacked electrical connector which includes an insulative housing defining a base portion, a couple of upper and lower tongue plates extending from the base portion for electrically engaging with mating connectors, as well as a holding plate between said tongue plates. First and second sets of conductive terminals are accommodated in the passageways of upper and lower tongue plates. An inner metal shield encloses the holding plate and an outer shell surrounding the insulative housing for preventing the connector from being affected by external electromagnetic interference (EMI). However the dimension of the holding plate in a vertical direction is short. When the corresponding connectors are inserted in the housing to connect with the stacked electrical connector, they may intervene with each other. Under this condition, the signal transmission might be unstable.

Hence, it is desired to have an electrical connector solving the problem above.

BRIEF SUMMARY OF THE INVENTION

Accordingly, an object of the present invention is to provide an electrical connector which can be inserted in by two corresponding mating connectors simultaneity and said mating connectors cannot intervene with each other.

In order to attain the objective above, an electrical connector adapted for electrically connecting with two corresponding mating connectors, includes an insulative housing and two mating interfaces. The insulative housing defines a base portion, a couple of upper and lower tongue plates extending into the corresponding interface, as well as a holding plate positioned between the tongue plates. A plurality of horizontal passageways are disposed in the upper and lower tongue plates lengthwise. Each interface includes a plurality of conductive terminals retained in the passageways of the tongue plates. Besides, each interface includes a shielding member abutting against the holding plate and enclosing the tongue plate. Each mating connector defines an insulator, an engaging portion enclosing the insulator and a dielectric portion disposed at the back of the engaging portion. The engaging portion has a plurality of contacts secured in the insulator. The dimension of the holding plate in a vertical direction is greater than the dimension of total adjacent dielectric portions between the engaging portions. When two mating connectors are inserted into the housing for connecting with the electrical connector, they cannot intervene with each other so as to affect signal transmission.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Reference will now be made in detail to the preferred embodiment of the present invention.

Figure 1:
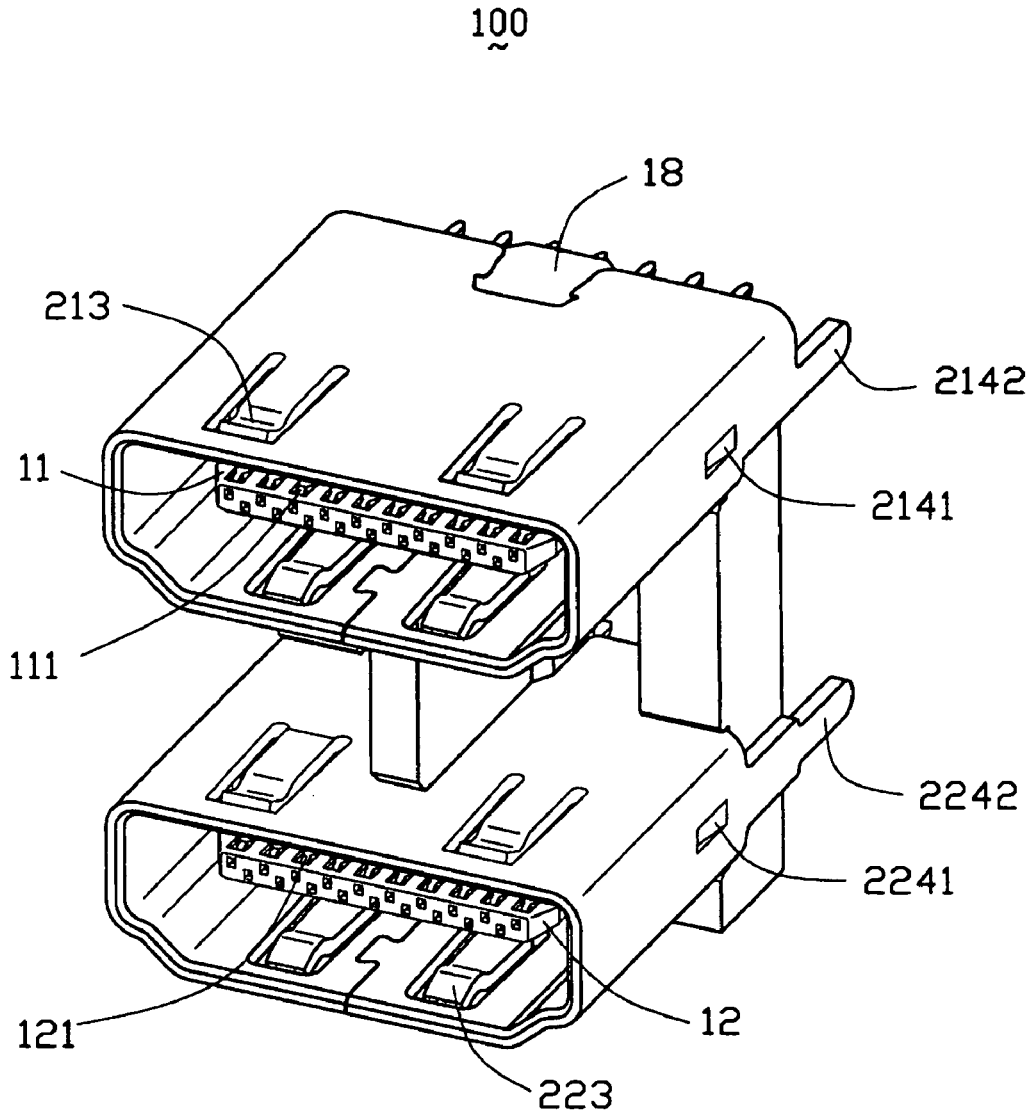
FIG. 1 is a perspective view of an electrical connector according to the present invention.
Figure 3:
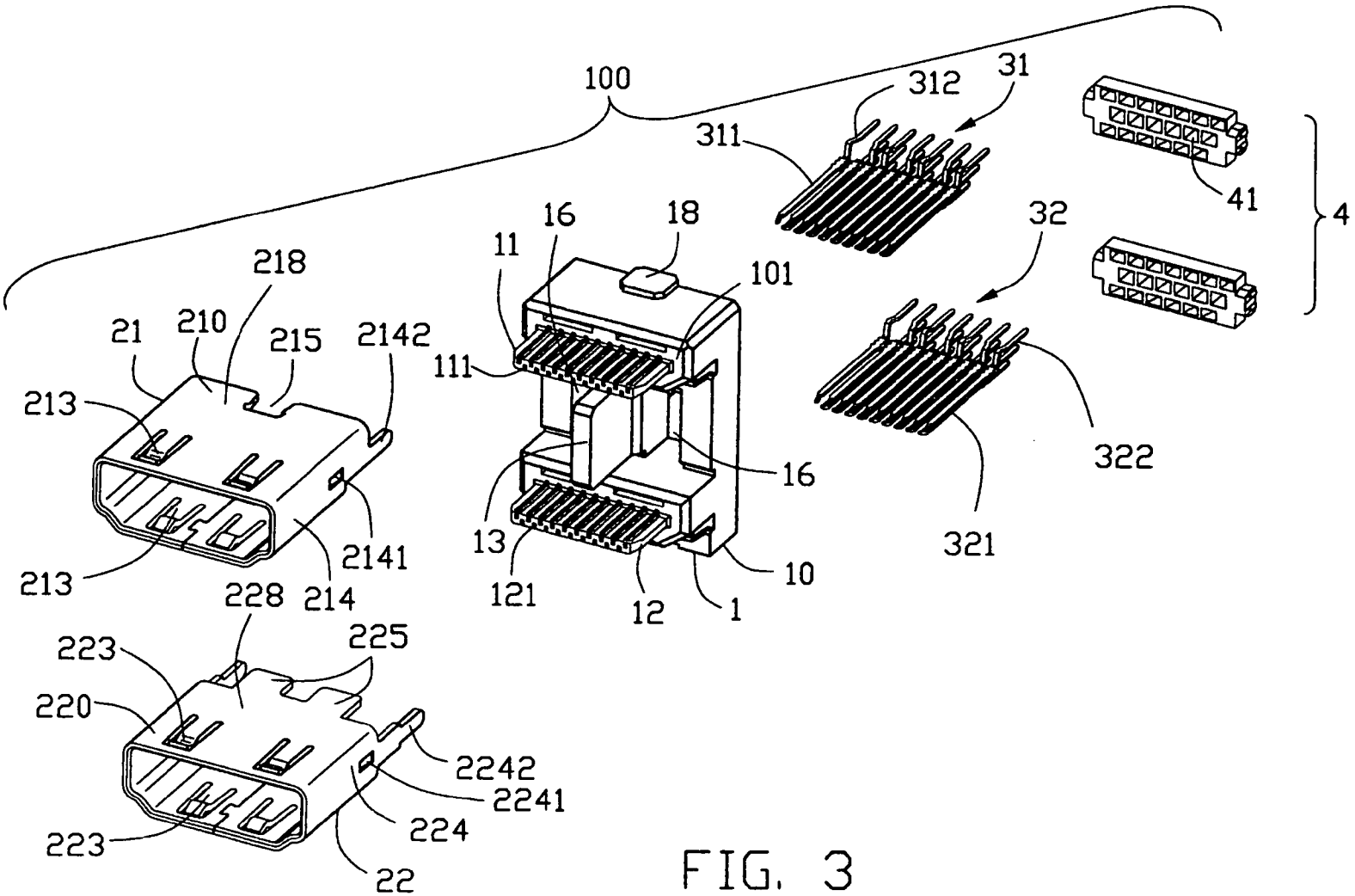
FIG. 3 is an exploded view of the electrical connector.
Figure 4:
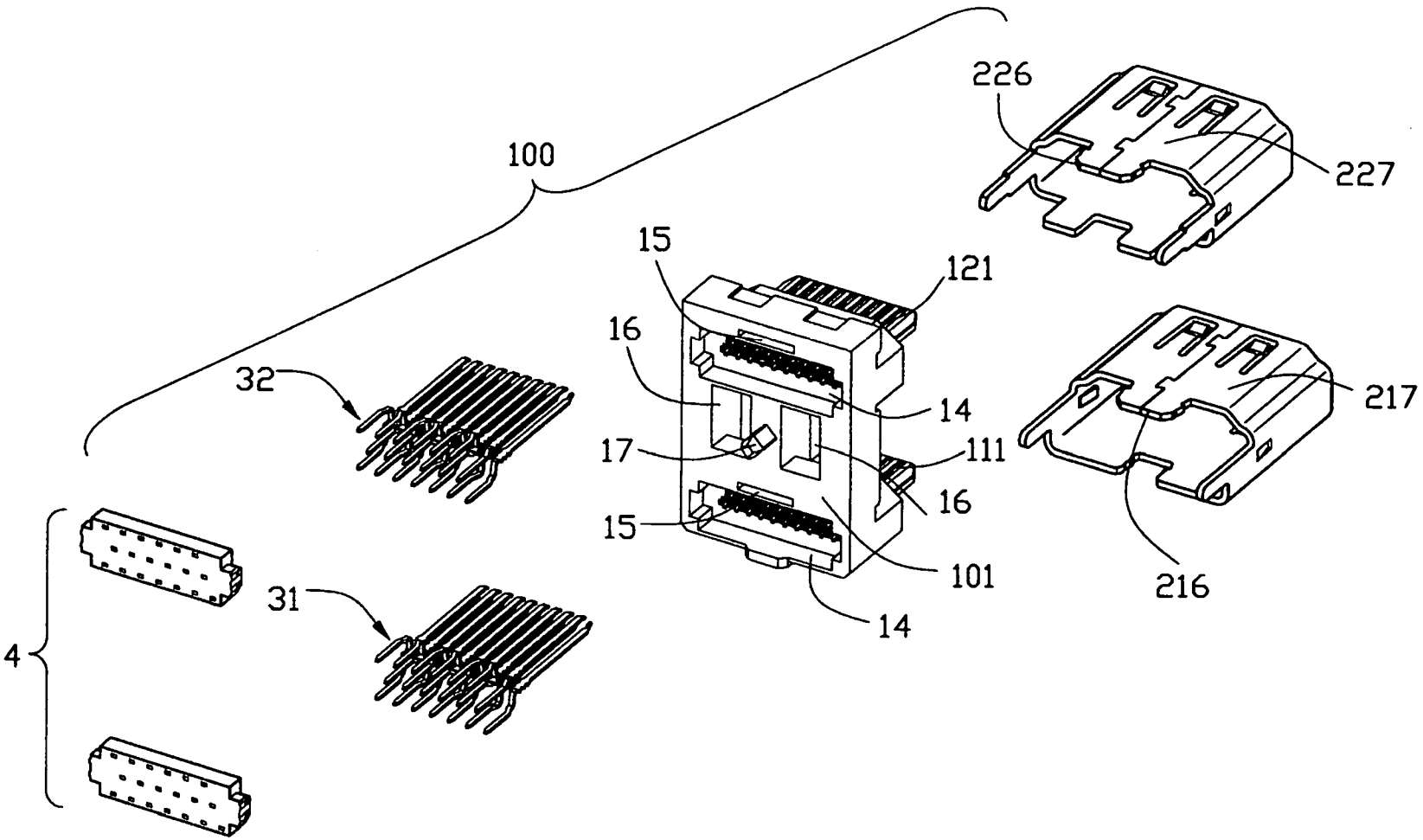
FIG. 4 is another exploded view of the electrical connector.

Referring to the drawings and in particular to FIGS. 1, 3 and 4, an electrical connector 100 mounted on a printed circuit board (not shown) for electrically connecting with two mating connectors 200, comprises an insulative housing 1, a pair of mating interfaces and a spacer 4. The interfaces have a first and a second set of conductive terminals 31, 32 accommodated in the insulative housing 1, and a pair of upper and lower shielding members 21, 22 surrounding the conductive terminals 31, 32. The insulative housing 1 includes a base portion 10, a couple of upper and lower tongue plates 11, 12 extending forwardly from a front wall 101 of the base portion 10. A plurality of horizontal passageways 111, 121 are disposed in the upper and lower surface of the tongue plates 11, 12 lengthwise for receiving first and second sets of conductive terminals 31, 32 therein. The passageways 111, 121 are stagger through the front wall 101 and the rear wall 102 of the housing 1. The insulative housing 1 further includes a holding plate 13 between the tongue plates 11, 12 for abutting against the shielding members 21, 22. There forms a pair of cross-shaped receiving chambers 14 in the rear wall 102 of the housing 1 in communication with the passageways 111, 121 for accommodating the spacer 4 therein. A post 17 extends outwardly from the rear wall 102 of the housing 1 between the receiving chambers 14 to be inserted into a hole of a printed circuit board (PCB, not shown) for fixing purpose. At the left and right sides of the post 17, there are two oblong apertures 16 extending through the front wall 101 and the rear wall 102 of the housing 1.

Successively, the upper and lower shielding members 21, 22 each defines a closed-type circumferential section 210, 220 formed by two side walls 214, 224, a top wall 218, 228 and a bottom wall 217, 227 wherein at least one side wall 214, 224 has a lance section 2141, 2241 extending into the closed-type circumferential section 210, 220 for latchable engagement with the insulative housing 1. Each side wall 214, 224 has an extending portion 2142, 2242 extending backward from the circumferential section 210, 220. As illustrated, both of the top walls 218, 228 and bottom walls 217, 227 define a pair of tangs 213, 223 extending into the circumferential section 210, 220 for abutting against the corresponding mating connector 200. Further more, the top wall 218 of the upper shielding member 21 has a cutout 215 for engaging with the standoff 18 of the housing 1 and the top wall 228 of the lower shielding member 22 has a discontinuous tab 225 opposite the circumferential section 210. Both of the bottom walls 217, 227 have protrusions 216, 226 for inserting into the slot 15 of the housing 1.

Figure 2:
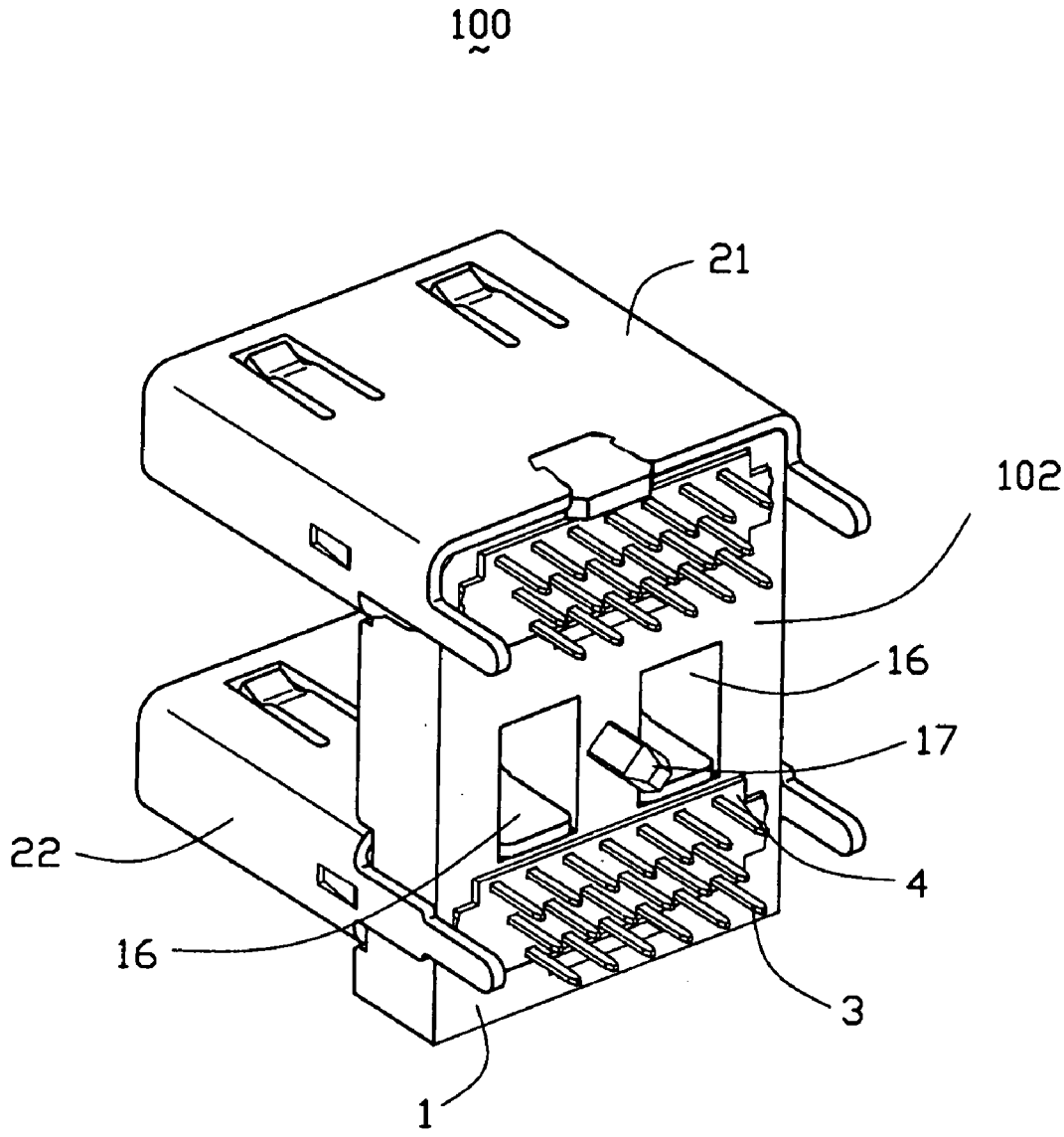
FIG. 2 is another perspective view of the electrical connector.

Further referring to FIG. 2, the First and second sets of conductive terminals 31, 32 have mating sections 311, 321 received in the passageways 111, 121 of the upper and lower tongue plates 11, 12 for electrically engaging with the mating connectors 200. The conductive terminals 31, 32 further comprise mounting sections 312, 322 perpendicularly bending and parallel extending from the mating sections 311, 321 and going beyond the rear wall 102 of the insulative housing 1 for being electrically connected to a printed circuit board (not shown).

Further referring to FIGS. 3-4 in conjunction with FIGS. 1-2, in assembly, first, the conductive terminals 31, 32 are inserted into the corresponding passageways 111, 121 along the tongue plates 11, 12 from the rear wall 102 of the insulative housing 1. Then, the shielding members 21, 22 are assembled from the front wall 101 of housing 1 to enclose the tongue plates 11, 12 wherein the protrusions 216, 226 are fastened in the slot 15. The cutout 215 engages with the standoff 18 and the discontinuous tab 225 mates with the apertures 16. At the same time, the holding plate 13 supports the top wall of the lower shielding member 21 and abuts against the bottom wall of the upper shielding member 22. Besides, each lance section 2141, 2241 of side walls 214, 224 is engaging with the insulative housing 1. Therefore, said shielding members 21, 22 are retained surrounding the tongue plates 11, 12 without moving relatively to the housing 1 wherein the lance sections 2141, 2241 prevent a back-to-forth movement of shielding members 21, 22. Meanwhile, the extending portions 2142, 2242 go beyond the rear wall of the insulative housing 1 to be inserted into holes of the PCB for fixing purpose. Finally, each cross-shaped spacer 4 is accommodated in the receiving chamber 14 of the insulative housing 1 and the conductive terminals 31, 32 run through the through holes 41 of the spacer 4 to be mounted on the printed circuit board.

Figure 5:
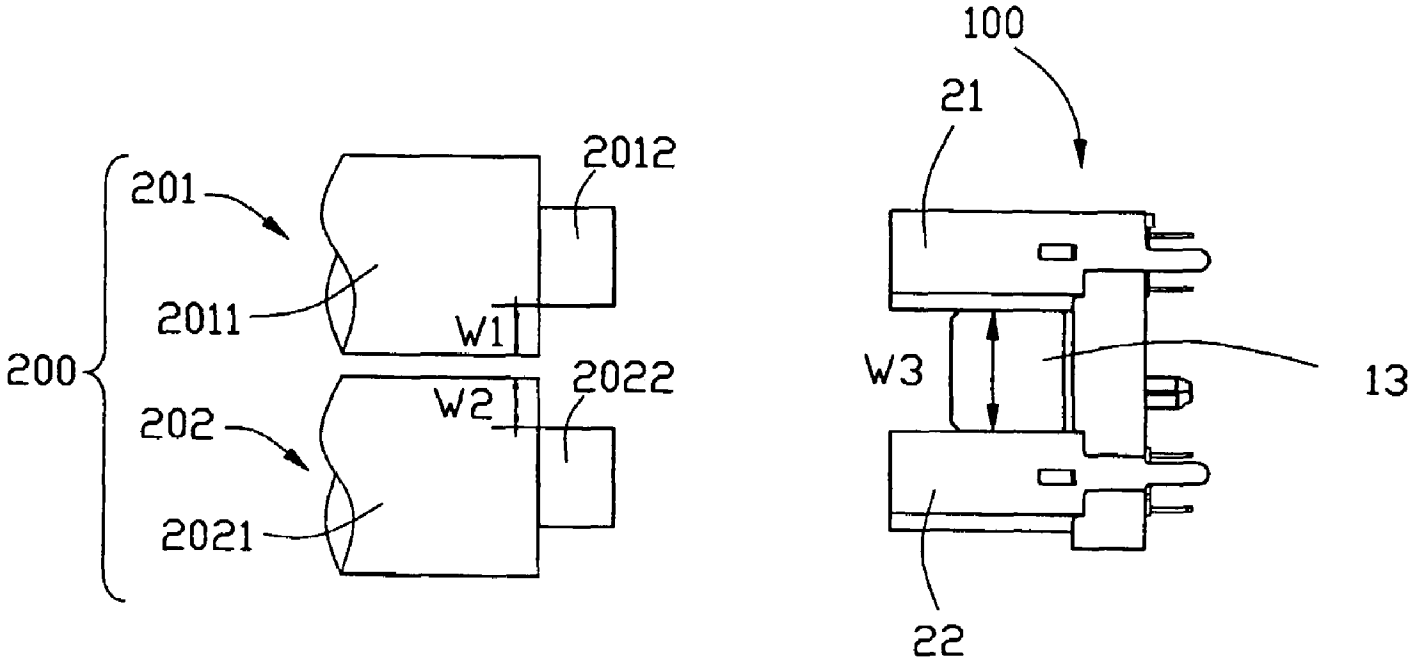
FIG. 5 is a side view of the electrical connector and two mating connectors.

Referring to FIG. 5, the mating connectors 200 include a first mating connector 201 and a second mating connector 202. The first mating connector 201 defines a first dielectric portion 2011 and a first engaging portion 2012 extending from the first dielectric portion 2011. The second mating connector 202 defines a second dielectric portion 2021 and a second engaging portion 2022 extending from the second dielectric portion 2021. Both the first and second engaging portions 2012, 2022 have a plurality of terminals (not shown) retained therein. The height of a lower portion of the first dielectric portion 2011 under the first dielectric portion 2011 is signed as W1. The height of an upper portion of the second dielectric portion 2021 over the second engaging portion is signed as W2. The dimension W3 of the holding plate 13 in the vertical direction is greater than the dimension W1 plus W2 of the adjacent dielectric portions 2011, 2021 between the engaging portions 2012, 2022. When the first and second engaging portions 2012, 2022 are inserted in the closed-type circumferential section 210, 220 of the mating interfaces to interconnect the electrical connector 100, the dielectric portions 2011, 2021 cannot intervene with each other so as to affect signal transmission.

Figure 6:
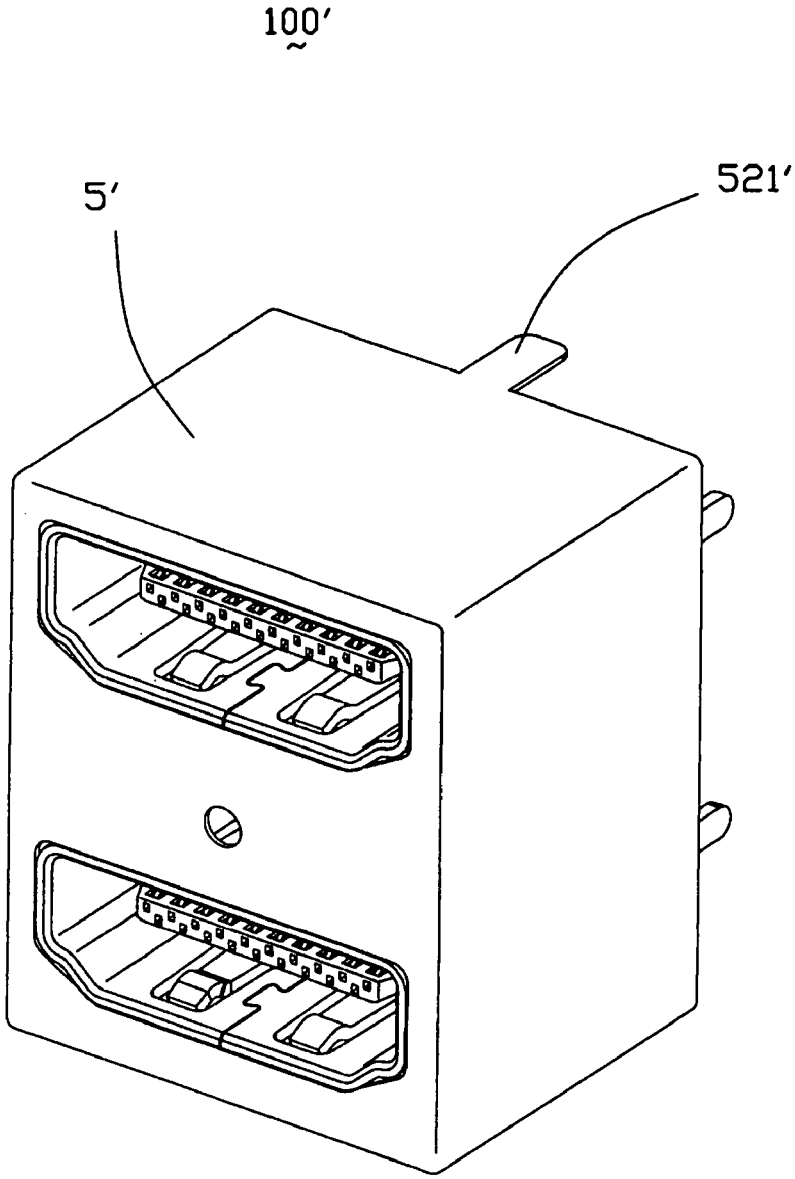
FIG. 6 is a perspective view of an electrical connector according to another embodiment.
Figure 7:
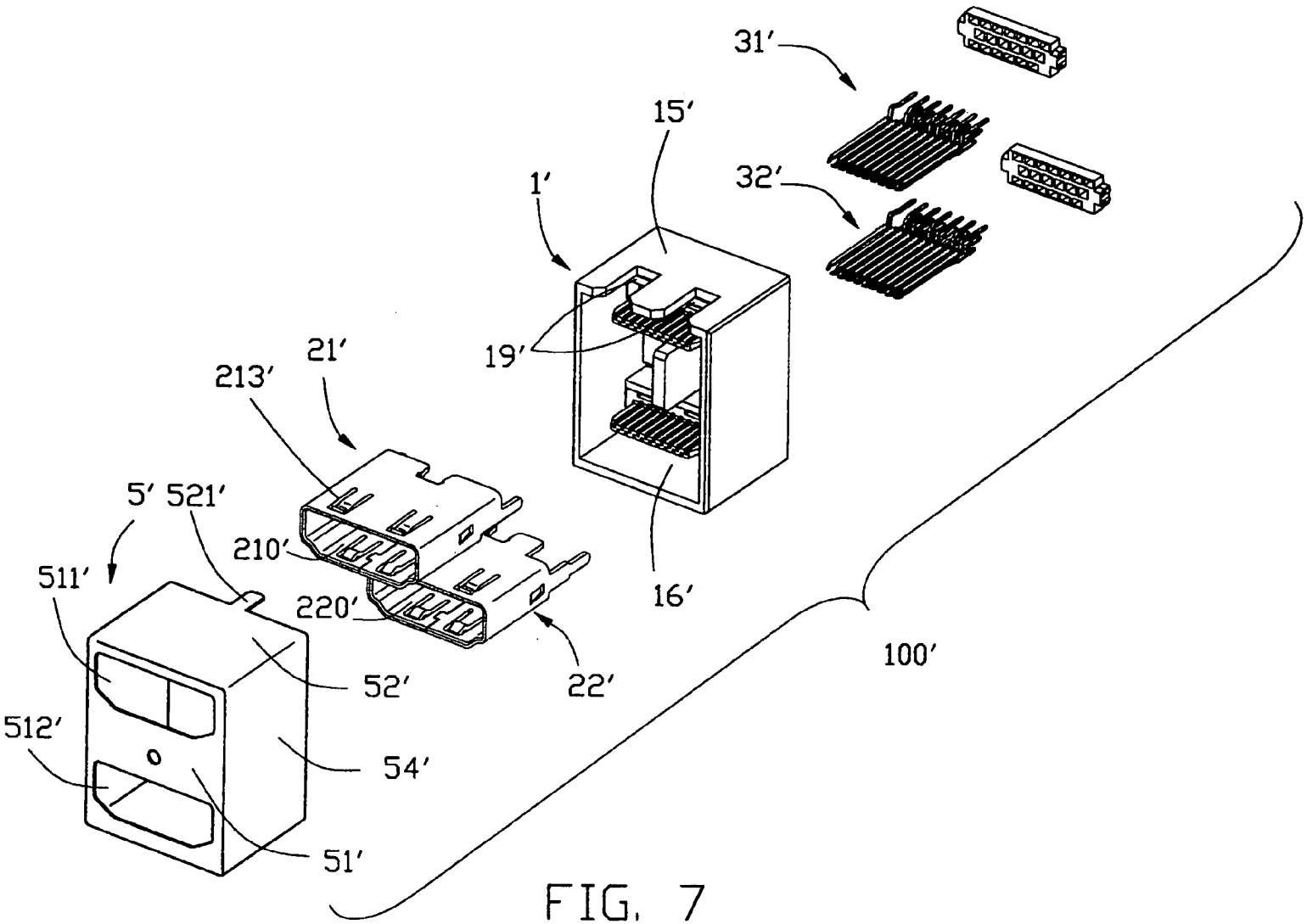
FIG. 7 is an exploded view of FIG. 6.
Figure 8:
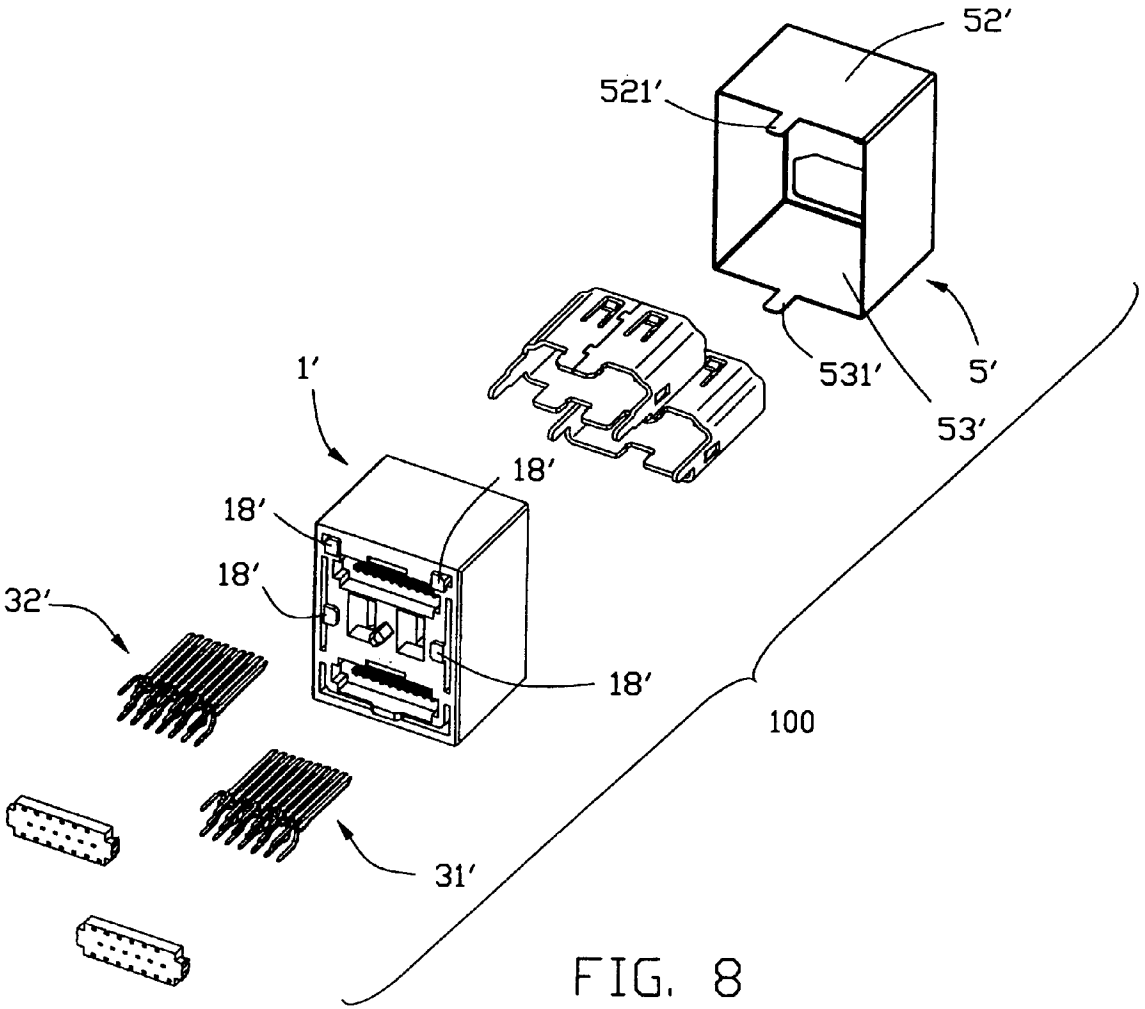
FIG. 8 is another view of FIG. 7.

Please refer to FIGS. 6-8, another embodiment is provided of the present invention. A stacked electrical connector 100" which is similar to the connector 100 wherein the differences between them are that the connector 100" comprises an outer shield 5" enclosing a rectangle-shaped insulative housing 1" forming an opening 16" in the front for accommodating shielding members 21", 22", and two slits 19" on the top wall 15" corresponding to the tangs 213" of the shielding members 21". The rear wall of the housing 1' further defines a number of engaging blocks 18" for preventing the conductive terminals 31", 32" from being set over-through the holes of the printed circuit board. The outer shield 5" includes a front wall 51", a top and bottom panels 52", 53" and two side panels 54". The front wall 51" defines an upper and a lower openings 511", 512" extending therefrom. Both of the top panel 52" and the bottom panel 53" contain a tab 521", 531" opposite the front wall 51" to be mounted on a circuit board. The openings 511", 512" are corresponding to the closed-type circumferential section 210", 220" of shielding members 21", 22". When assembly, the outer shield 5" is covered to the housing 1" for EMI purpose.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector assembly comprising:

a first connector having an insulative housing, at least two mating interfaces and a holding plate disposed between adjacent two mating interfaces, each interface comprising a plurality of contacts and a shielding member enclosing corresponding contacts and abutting against the holding plate; and a first and a second mating connector respectively to engage with the mating interfaces, the first mating connector having a first engaging portion and a first dielectric portion, the second mating connector having a second engaging portion and a second dielectric portion, both of the first and second engaging portions having a plurality of terminals received therein, wherein the dimension of the holding plate in a vertical direction is greater than total height of a lower portion of the first dielectric portion under the first engaging portion and an upper portion of the second dielectric portion over the second engaging portion.

2. The electrical connector according to claim 1, wherein the insulative hosing defines a base portion and at least two tongue plates extending from the base portion, each tongue plate defining a plurality of passageways for receiving the contacts.

3. The electrical connector according to claim 2, wherein the tongue plate defines an upper surface and a lower surface, said passageways alternately disposed on the upper and lower surface.

4. The electrical connector according to claim 2, wherein the holding plate is integrally extending from the insulative housing.

5. The electrical connector according to claim 1, wherein the interfaces include an upper interface and a lower interface stacked under the upper interface.

6. The electrical connector according to claim 1, wherein the shielding member defines a circumferential section and a tang extending into the circumferential section for abutting against the corresponding mating connector.

7. The electrical connector according to claim 1, wherein the shielding member includes a lance section for engaging with the insulative housing.

8. The electrical connector according to claim 1, further comprising a spacer retained in the insulative housing, the spacer defining a plurality of through holes for the contacts extending therethrough.

9. The electrical connector according to claim 1, the insulative housing defines a cavity, said holding plate extending into the cavity.

10. An electrical connector comprising:

a unitary insulative housing having a base with upper and lower sections;

an upper tongue plate extending forwardly from the upper section under a condition that no other portions of the housing located right above the upper tongue plate;

a lower tongue plate extending forwardly from the lower section under a condition that no other portions of the housing located right below the lower tongue plate;

a plurality of upper contacts disposed in the upper section and exposed on the upper tongue plate;

a plurality of lower contacts disposed in the lower section and exposed on the lower tongue plate;

an upper metallic shell assembled to the upper section and enclosing the upper tongue plate; and a lower metallic shell discrete from the upper metallic shell and assembled to the lower section and enclosing the lower tongue plate.

11. The electrical connector as claimed in claim 10, wherein a holding plate is located between the upper metallic shell and the lower metallic shell.

12. The electrical connector as claimed in claim 11, wherein said holding plate abuts against the upper metallic shell and the lower metallic shell.

13. The electrical connector as claimed in claim 12, wherein the holding plate is unitarily formed with the housing.

14. An electrical connector comprising:

a box-like unitary insulative housing having a base with upper and lower sections;

an upper tongue plate extending forwardly from the upper section;

a lower tongue plate extending forwardly from the lower section, both said upper tongue plate and said lower tongue plate being positioned behind a front face of the housing;

a plurality of upper contacts disposed in the upper section and exposed on the upper tongue plate;

a plurality of lower contacts disposed in the lower section and exposed on the lower tongue plate;

an upper metallic shell assembled to the upper section and enclosing the upper tongue plate; and a lower metallic shell discrete from the upper metallic shell and assembled to the lower section and enclosing the lower tongue plate; wherein before the upper and lower metallic shells are assembled to the corresponding upper and lower sections, the upper tongue plate and the lower tongue plate directly vertically communicate with each other, but are vertically segregated from each other after the upper and lower metallic shells are assembled to the corresponding upper and lower sections.

* * * * *